US005964047A

United States Patent [19]

Covatch

[11] Patent Number: 5,964,047

[45] **Date of Patent: *Oct. 12, 1999**

[54] WATERPROOF FOOTWEAR

[75] Inventor: Charles E. Covatch, Martinsburg, Pa.

[73] Assignee: Columbia Insurance Company, Omaha, Nebr.

[ * ] Notice: This patent issued on a continued prosecution application filed under 37 CFR 1.53(d), and is subject to the twenty year patent term provisions of 35 U.S.C. 154(a)(2).

[21] Appl. No.: 08/953,540

[22] Filed: Oct. 20, 1997

[51] Int. Cl.[6] ..... A43B 23/07

[52] U.S. Cl. ..... 36/55; 36/10

[58] Field of Search ..... 36/10, 55, 14

[56] References Cited

U.S. PATENT DOCUMENTS

| | | |
|---|---|---|
| 2,329,209 | 9/1943 | Manson et al. . |
| 2,724,676 | 11/1955 | Randall et al. . |
| 2,728,999 | 1/1956 | L'Hollier . |
| 3,362,091 | 1/1968 | Drago . |
| 3,407,406 | 10/1968 | Werner et al. . |
| 3,822,488 | 7/1974 | Johnson . |
| 4,430,811 | 2/1984 | Okada . |
| 4,845,862 | 7/1989 | Phillips, Jr., et al. . |
| 4,967,494 | 11/1990 | Johnson . |
| 5,289,644 | 3/1994 | Driskill et al. . |
| 5,499,459 | 3/1996 | Tomaro . |
| 5,678,325 | 10/1997 | Davidowitz . |
| 5,802,740 | 9/1998 | Merk, Sr. . |

*Primary Examiner*—Ted Kavanaugh
*Attorney, Agent, or Firm*—Fish & Richardson P.C.

[57] ABSTRACT

An article of footwear includes an outer boot having a sole and an upper that together define a volume for receiving and protecting a wearer's foot against external elements, an outer waterproof bootie sized and shaped to fit snugly within the volume, and an inner bootie disposed within the outer bootie. The outer bootie has a waterproofing layer impervious to penetration by water for keeping the wearer's foot dry in wet conditions, and a thermal insulating layer for preventing thermal loss. The inner bootie includes another thermal insulating layer for further preventing thermal loss.

16 Claims, 2 Drawing Sheets

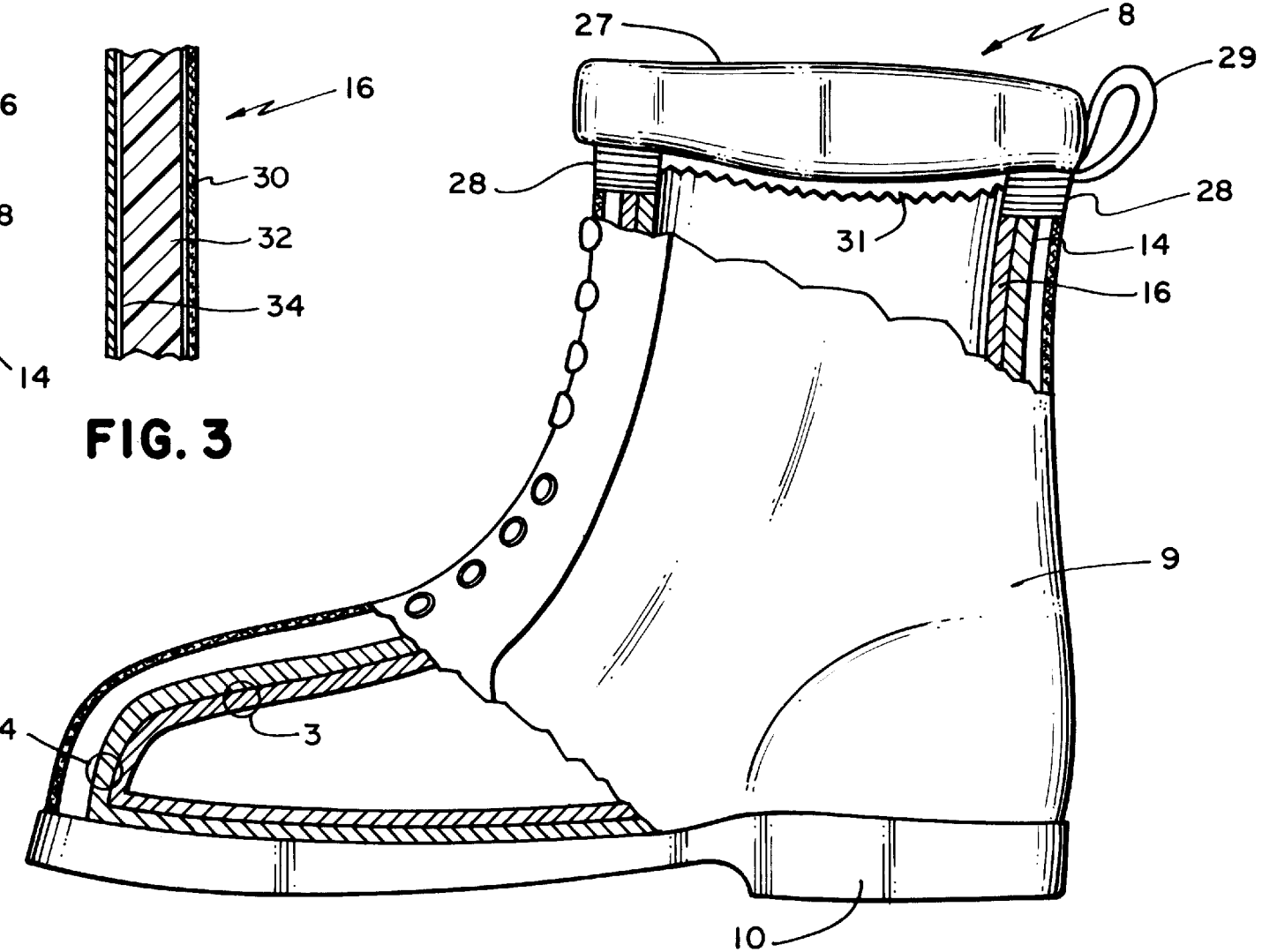
FIG. 2
FIG. 3
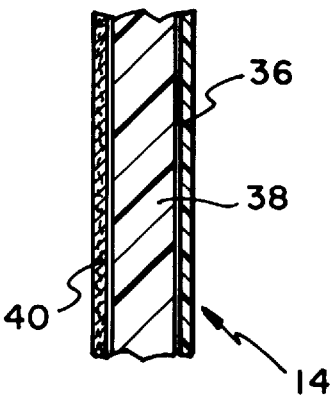
FIG. 4

WATERPROOF FOOTWEAR

FIELD OF THE INVENTION

This invention relates to footwear.

BACKGROUND OF THE INVENTION

Shoes and boots may be provided with a permanent bootie positioned within the interior of the shoe or boot to serve as a lining for the boot, thereby providing comfort and support to the wearer's foot. The construction of the shoe or boot and the thickness and characteristic of the bootie often depends on the particular weather conditions in which the shoe or boot is to be used. For example, a boot for use in colder, wetter climates often includes a relatively thick, well insulated bootie construction intended to keep the foot of the wearer comfortable and warm. Additionally, the bootie may include a waterproof, breathable layer that keeps the foot dry by preventing moisture from entering the bootie while allowing perspiration to escape.

SUMMARY OF THE INVENTION

In a general aspect of the invention, an article of footwear includes an outer shoe or boot having a sole and an upper that together define a volume for receiving and protecting a wearer's foot against external elements, an outer waterproof bootie sized and shaped to fit snugly within the volume, and an inner bootie disposed within the outer bootie. The outer waterproof bootie includes a waterproofing layer impervious to penetration by water for keeping the wearer's foot dry in wet conditions, and a thermal insulating layer for preventing thermal loss. The inner bootie includes another thermal insulating layer for further preventing thermal loss.

Among other advantages, fabricating the two booties separately, each having its own thermal insulating layer, and then placing one in the other overcomes difficulties associated with stitching or quilting a single bulky and unwieldy layer of insulation. Moreover, the waterproofing layer of the outer bootie protects internal layers and the wearer's foot from moisture which might leak or otherwise accumulate into the boot or shoe.

Embodiments of the above aspect of the invention may include one or more of the following features. The outer waterproof bootie includes a backing layer positioned adjacent to its thermal insulating layer for maintaining the shape of the insulating layer, and the inner bootie includes a liner layer for contacting the wearer's foot and allows transmission of perspiration away from the wearer's foot. The inner bootie also includes a backing layer positioned adjacent to its thermal insulating layer for maintaining the shape of the insulating layer, particularly during attachment to adjacent layers. The waterproofing layer is the outermost layer of the outer bootie. The thermal insulating layer of the outer bootie is disposed between the waterproofing layer and the backing layer of the outer bootie. The backing layer of the inner bootie is positioned adjacent to the backing layer of the outer bootie so that the thermal insulating layer of the inner bootie is disposed between the liner layer and the backing layer of the inner bootie.

In certain embodiments, the inner bootie is fixedly attached (e.g., with adhesive) to a sole of the outer bootie providing a single, two part bootie construction. The inner and outer booties may be stitched together and then stitched to the outer boot at an ankle portion of the upper of the boot to prevent any moisture which might be absorbed within an outer layer of the outer bootie and that migrates to the upper end of the outer bootie from reaching the inner bootie.

The liner layer of the inner bootie is made of brushed polyester to provide comfort to the wearer's foot. The waterproofing layer of the outer bootie is breathable and made from polytetrafluoroethylene (PTFE) laminate. The thermal insulating layers are made of non-woven synthetic fibers. The weight of each of the thermal insulating layers of the inner and outer booties is in a range between about 500 grams and 1200 grams, with the combined weight of both thermal insulating layers together being in a range between about 1200 grams and 1800 grams. For example, the weight of the thermal insulating layer of the outer bootie may be 1000 grams, and the weight of the thermal insulating layer of the inner bootie may be 600 grams.

In another aspect of the invention, a method for construction of an article of footwear includes: providing a shoe or boot having a sole and an upper, the sole and upper together defining a volume; fabricating an outer waterproof bootie and an inner bootie, both of which are sized and shaped to fit snugly within the volume; fixedly attaching the inner bootie to the outer bootie; and placing the combination of the outer waterproof bootie and inner bootie within the volume of the shoe or boot. The outer waterproof bootie is fabricated by placing a thermal insulating layer between an outermost waterproofing layer and a backing layer, and stitching (e.g., quilting) the waterproofing layer, thermal insulating layer and backing layer together. The inner bootie is fabricated by placing another thermal insulating layer between a liner layer and another backing layer, the liner layer being an innermost layer, and quilting the liner layer, thermal insulating layer and backing layer together. The inner bootie is placed within the outer waterproof bootie so that the backing layer of the inner bootie is adjacent to the backing layer of the outer bootie. In certain embodiments, the outer waterproof bootie and the inner bootie are stitched together and to an ankle portion of the upper of the shoe or boot to prevent seepage of moisture into the inner bootie.

Other features and advantages will become apparent from the following description and from the claims.

BRIEF DESCRIPTION OF THE DRAWING

FIG. 2 is a cross-sectional view of the boot of FIG. 1.

FIG. 3 is a close-up cross-sectional view of area 3 of FIG. 2.

FIG. 4 is a close-up cross-sectional view of area 4 of FIG. 2.

DESCRIPTION

Figure 1:
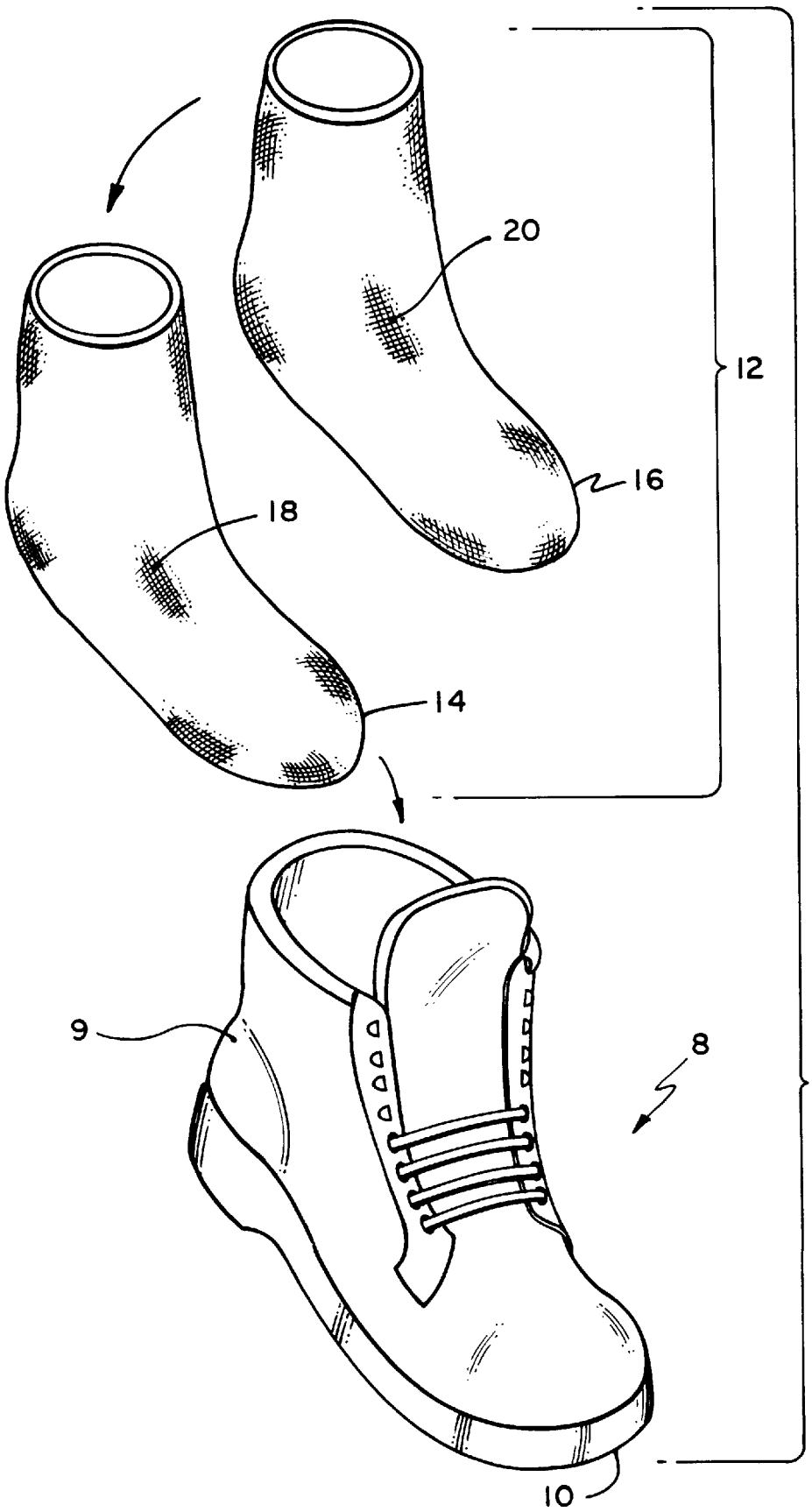
FIG. 1 is an exploded perspective view of a boot equipped with a double-bootie.

Referring to FIG. 1, an outer boot 8 having an upper 9 and a sole 10 is equipped with a water-tight double bootie 12 sized and shaped to fit snugly within the volume of the outer boot. Water-tight double bootie 12 includes an outer waterproof bootie 14 and an inner bootie 16 disposed within outer waterproof bootie 14. Each bootie 14, 16 is of quilted construction in which individual layers of the booties are stitched together in a quilted pattern 18 and 20, respectively. The double-bootie construction facilitates the fabrication of two separate booties, each having its own thermal insulating layer, thereby overcoming the difficulties associated with fabricating a single bootie with a thermal insulating layer having a thickness substantially that of the combined thickness of the insulating layers of the two separate booties.

Referring to FIG. 2, a sole 15 of inner bootie 16 is fixedly attached to outer bootie 14 with an adhesive 17. Outer waterproof bootie 14 and inner bootie 16 are permanently stitched together and to outer boot 8 at an ankle region 28 with stiching 31 of upper 9 to prevent seepage of moisture into the inner bootie. A padded collar 27 having an outer covering of leather or plastic is sewn around ankle region 28 to provide comfort to the wearer's ankle of boot 8 and booties 14 and 16. A looped tab 29 is attached to the rear collar portion of boot 8 to facilitate insertion of the foot within the booties.

Each bootie 14, 16 includes three separate layers fabricated of materials selected to provide comfort during use in cold and/or wet weather. In particular, referring to FIG. 3, inner bootie 16 includes a liner fabric layer 30 formed of a fleece-like, brushed polyester material for providing comfort to and absorbing perspiration from the foot of the wearer. A thermal insulating layer 32 is positioned adjacent to liner fabric layer 30 for keeping the wearer's foot warm by preventing thermal loss. A suitable material for insulating layer 32 is Thinsulate®, a thermal insulation made of non-woven synthetic fibers commonly used in clothing and sleeping bags and produced by Minnesota Mining and Manufacturing Company, St. Paul, M,NN. An insulating layer 32 formed of Thinsulate® has, in this embodiment, a weight of 600 grams. Note that the weight of the insulating material is related to an industry standard—46 grams being equal to 1.4 oz per square yard of material without the scrim, a thin carrier layer on which the insulating material is typically provided with before use. Finally, a thin backing material 34 (e.g. made of synthetic resins, such as Cerex® produced by Monsanto Chemical Company, St. Louis, M.) is provided next to insulating layer 32 for maintaining the shape of the insulating layer during the fabrication process (e.g. quilting and stitching) of inner boot 16.

Referring now to FIG. 4, outer bootie 14 includes a backing layer 36 positioned adjacent to a thermal insulating layer 38 which provides further warmth to the foot of the wearer and to backing layer 34 of the inner bootie. A suitable material for insulating layer 38, like insulating layer 32, is Thinsulate®. In the illustrated embodiment, insulating layer 38 formed of Thinsulate® has a weight of 1000 grams so that the combined weight of insulating layers 32 and 38 is about 1600 grams. As similarly described for inner bootie 16, backing layer 36 of outer bootie 14 maintains the shape of insulating layer 38 during the fabrication process. An outer waterproofing layer 40 (made from, for example, polytetrafluoroethylene laminate, such as Gore-Tex® manufactured by W. L. Gore & Associates, Inc., Newark, Del.) is provided next to insulating layer 38. Waterproofing layer 40 is selected to provide protection for the wearer's foot against water, e.g. absorbed through upper 9 of boot 8 or otherwise collecting within the interior volume of the boot. Furthermore, waterproofing layer 40 is breathable to enable perspiration from the wearer's foot to escape from the booties. When waterproofing layer 40 is positioned as the outermost layer of double bootie 12, insulating layers 32 and 38 are protected from moisture that may leak into the boot. Otherwise, moisture could wick throughout the insulating layers causing the boot or shoe to become heavy, and, therefore, uncomfortable to wear.

What is claimed is:

1. An article of footwear comprising:

a shoe or boot having a sole and an upper, said sole and upper together defining a volume for receiving and protecting a wearer's foot against external elements;

an outer waterproof bootie sized and shaped to fit snugly within said volume, said outer waterproof bootie including:

a waterproofing layer impervious to penetration by water for keeping the wearer's foot dry in wet conditions;

a first thermal insulating layer for preventing thermal loss; and first stitching for attaching the waterproofing layer to the first thermal insulating layer; and an inner bootie constructed to maintain its shape separate from said outer bootie, said inner bootie disposed within the outer bootie, said inner bootie including:

a second thermal insulating layer for further preventing thermal loss; and second stitching, separate from said first stitching, and passing through said second thermal insulating layers;

wherein said first stitching associated with said outer bootie is in the form of first quilting and said second stitching associated with said inner bootie is in the form of second quilting.

2. The article of footwear of claim 1 wherein said outer waterproof bootie further comprises a first backing layer positioned adjacent to the first thermal insulating layer for maintaining the shape of said first thermal insulating layer, and said inner bootie further comprises a liner layer for contacting the wearer's foot and which allows transmission of perspiration away from the wearer's foot, and a second backing layer positioned adjacent to the second thermal insulating layer for maintaining the shape of said second thermal insulating layer, said first stitching attaching said first backing layer, waterproofing layer, and said first thermal insulating layer together, said second stitching attaching said second thermal insulating layer, liner layer and second backing layer together.

3. The article of footwear of claim 2 wherein said liner layer is made of brushed polyester.

4. The article of footwear of claim 2 wherein said first and second backing layers are made of synthetic resin.

5. The article of footwear of claim 2 wherein said waterproofing layer is the outermost layer of said outer bootie and said first thermal insulating layer is disposed between said waterproofing layer and said first backing layer.

6. The article of footwear of claim 5 wherein said second backing layer of said inner bootie is positioned adjacent to said first backing layer of said outer bootie so that said second thermal insulating layer is disposed between said liner layer and said second backing layer.

7. The article of footwear of claim 2 wherein said second thermal insulating layer is disposed between said liner layer and said second backing layer.

8. The article of footwear of claim 1 wherein said waterproofing layer is the outermost layer of said outer bootie.

9. The article of footwear of claim 1 wherein a sole portion of said inner bootie is fixedly attached to a sole of said outer bootie.

10. The article of footwear of claim 9 wherein said inner bootie and said outer bootie are stitched together and to said outer boot at an ankle portion of said upper.

11. The article of footwear of claim 1 wherein said waterproofing layer is breathable and made from polytetrafluoroethylene laminate.

12. The article of footwear of claim 1 wherein said first and said second thermal insulating layers are made of non-woven synthetic fibers.

13. The article of footwear of claim 12 wherein each of said first and second thermal insulating layers has a weight between 500 grams and 1200 grams.

14. The article of footwear of claim 13 wherein said first thermal insulating layer has a weight of 1000 grams.

15. The article of footwear of claim 13 wherein said second thermal insulating layer has a weight of 600 grams.

16. An article of footwear comprising:

a shoe or boot having a sole and an upper, said sole and upper together defining a volume for receiving and protecting a wearer's foot against external elements;

an outer bootie sized and shaped to fit snugly within said volume, said outer waterproof bootie including:

a waterproofing layer impervious to penetration by water for keeping the wearer's foot dry in wet conditions, a first thermal insulating layer, and a first backing layer for maintaining the shape of said first thermal insulating layer, first stitching for attaching the waterproofing layer, the first thermal insulating layer, and the first backing layer together; said waterproofing layer being an outermost layer, and said first thermal insulating layer disposed and providing thermal insulation, between said waterproofing layer and said first backing layer; and an inner bootie constructed to maintain its shape separate from said outer bootie, said inner bootie disposed within the outer bootie including:

a liner layer for contacting a wearer's foot and allowing transmission of perspiration away from the wearer's foot, a second thermal layer, and a second backing layer for maintaining the shape of said second thermal insulating layer, and second stitching for attaching said second thermal insulating layer, liner layer and second backing layer together, said second backing layer position adjacent to said first backing layer so that said second thermal insulating layer is disposed between said liner layer and said second backing layer;

wherein said first stitching associated with said outer bootie is in the form of first quilting and said second stitching associated with said inner bootie is in the form of second quilting.

* * * * *

UNITED STATES PATENT AND TRADEMARK OFFICE

CERTIFICATE OF CORRECTION

PATENT NO. : 5,964,047
DATED : October 12, 1999
INVENTOR(S) : Charles E. Covatch It is certified that error appears in the above-identified patent and that said Letters Patent is hereby corrected as shown below:

Column 3,
Line 22, change "M, NN." to -- MN. --.
Line 30, change "M." to -- MO. --.

Column 4, claim 1,
Line 16, change "layers" to -- layer --.

Signed and Sealed this

Fifth Day of March, 2002

*Attest:*

*Attesting Officer*

JAMES E. ROGAN
*Director of the United States Patent and Trademark Office*